United States Patent [19]

Hamilton

[11] 4,123,820

[45] Nov. 7, 1978

[54] CURTAIN SUSPENSION AND DRAWING SYSTEM, AND RAIL THEREFOR

[76] Inventor: Robert Hamilton, 5, The Rise, Elstree, Herfordshire, England

[21] Appl. No.: 706,592

[22] Filed: Jul. 19, 1976

[51] Int. Cl.[2] ..... A47H 1/04

[52] U.S. Cl. ..... 16/95 D; 160/126; 160/345

[58] Field of Search ..... 16/93 D, 94 D, 95 D, 16/96 D, 95 R, 87.4 R; 160/168, 126, 345, 346, 347

[56] References Cited

U.S. PATENT DOCUMENTS

| | | | |
|---|---|---|---|
| Re. 26,269 | 9/1967 | Ford | 16/94 DX |
| 2,897,515 | 8/1959 | Collins | 16/95 D |
| 3,192,994 | 7/1965 | Graber et al. | 160/126 X |
| 3,424,225 | 1/1969 | Magnusson | 160/345 |
| 3,430,678 | 3/1969 | Steck et al. | 16/93 D X |
| 3,470,578 | 10/1969 | Graber et al. | 16/94 D |
| 3,513,900 | 5/1970 | Ronfola | 160/126 |
| 3,795,266 | 3/1974 | Debs | 160/168 |
| 3,881,218 | 5/1975 | Palmer | 16/87.4 R X |
| 3,971,601 | 7/1976 | Sytsma | 16/107 X |

FOREIGN PATENT DOCUMENTS

| | | | |
|---|---|---|---|
| 64,128 | 5/1968 | German Democratic Rep. | 16/95 D |

*Primary Examiner*—Werner H. Schroeder
*Assistant Examiner*—Moshe I. Cohen
*Attorney, Agent, or Firm*—Brisebois & Kruger

[57] ABSTRACT

A rail for a curtain and the like suspension and drawing system comprises continuous drawn or extruded material of generally hollow or tubular shape whose cross section is such as to provide a pair of parallel longitudinal slots for guiding the oppositely running laps of a flat draw belt in an on-edge attitude so that its width is vertical, the rail being capable of flexure or bending in directions normal to the vertical plane of the belt to conform to a curved bay. The slots are separated by an integral web, and each has a longitudinal outwardly directed opening through which a member can project carrying at the inner end a belt clamp and at the other end a master glider running along a track parallel to the slots. The glider track, which may also serve to support free running gliders, may be formed by a surface which is an integral part of the rail adjacent the opening in the slot, for example, at least one longitudinal face edge of the opening.

10 Claims, 18 Drawing Figures

CURTAIN SUSPENSION AND DRAWING SYSTEM, AND RAIL THEREFOR

The present invention relates to curtain, and the like, suspension and drawing systems which expression includes curtains, louvre drapes, and any elements capable of being suspended and transported by means of gliders.

Among the objects of the invention are to provide a suspension system which includes an improved drawing system using a flexible drawing means and a supporting rail capable of heavy duty use over long periods and capable of being accommodated to curved window bays, and to smoothly curved reverse bends, such as "S" configurations, without the risk of the flexible drawing means fouling upon other parts of the system or being deflected out of its true position and leaving the prescribed path.

According to the invention a rail for a curtain and the like suspension and drawing system comprises continuous drawn or extruded material of generally hollow or tubular shape whose cross section is such as to provide a pair of parallel longitudinal slots for guiding the oppositely running laps of a flat draw belt in an on-edge attitude so that its width is vertical, the rail being capable of flexure or bending in directions normal to the vertical plane of the belt to conform to a curved bay. The slots are separated by an integral web and each has a longitudinal outwardly directed opening giving access to a member carrying at the inner end a belt clamp and at the other end a master glider running along a track parallel to said slots.

A reversing pulley block and a guide block may be fitted to opposite ends of the rail, preferably by making the blocks with moulded sockets conforming to the external shape of the rail.

In a first example of the invention the rail has a pair of vertically spaced similar slots for a belt and a further (third) slot for the two master gliders anchored to the belt. All three of these slots may be in spaced alignment in the direction of their greater dimension, i.e. in the width dimension of the belt. In such an example each master glider device is connected to the belt span by a clamp, for example, a screw clamp, which is coupled to a guide plate, preferably of smoothly curved shape, arranged to slide along an outside surface of the rail. The third slot constitutes a track for a glider element, or a pair of glider elements, which are also coupled to the guide plate. The connections between the guide plate, the clamp and the glider element or elements are such that the latter can track in the slot without jamming or jumping even when transversing a reverse bend in the rail. Deflection pulleys are provided at the "draw" end of the rail, and return pulleys at the other end. In each case there may be a pulley block housing, in one case, a pair of deflecting pulleys and, in the other case, a pair of return pulleys, these pulleys having their axes suitably inclined for their respective functions.

In a further example the rail may have a pair of slots for the belt laps, each of which slots is contiguous with a second or smaller slot. In such an arrangement the belt and the master glider clamp runs in the first, or larger slots, and the gliders in the second, or smaller, slot but at the same level as the corresponding belt laps, instead of in a separate channel spaced away from the belt slots. Again, each master glider device has a smoothly curved guide plate.

In a third example, the master glider devices are arranged to run in a common third slot, instead of in two separate slots adjacent the belt slots, and the rail is so shaped that said third slot is spaced laterally from the belt slots and is symmetrical with respect thereto. In this case the master glider devices, although clamped to different spans of the belt, both run at the same level in the common third slot.

In a further example, the rail may be symmetrical about a central vertical web which divides the rail into two similar compartments each taking one lap of the belt. Such a rail has equal flexing or bending ability in opposite directions about the web. The vertically symmetrical section may be of hollow box shape, or may be generally circular and horizontally split at each side to provide tracks for the curtain gliders and to allow connection to the curtain from each master glider.

Examples of the curtain rail systems according to the invention will now be described in more detail with reference to the accompanying diagrammatic drawings, in which:

FIG. 10 shows the rail in cross-section;

FIG. 11 shows free running gliders supported in each outer slot in the rail, and a front glider ring embracing the rail;

FIG. 12 shows the rail supported by a bracket and carrying a combined master glider and clamp for the rear lap of the belt; a rear master glider ring is also shown in position;

FIG. 13 shows a partly perspective view of the system of FIG. 12;

FIG. 14 shows a front ring and master glider in perspective;

FIG. 15 shows in elevation the end parts of the curtain rail system of FIGS. 10 to 14 with a pair of end brackets, one containing a reversing roller and the other a pair of deflecting or guide rollers for the belt;

FIG. 16 is a schematic sketch of the draw belt and pulleys on a smaller scale;

Figure 1:
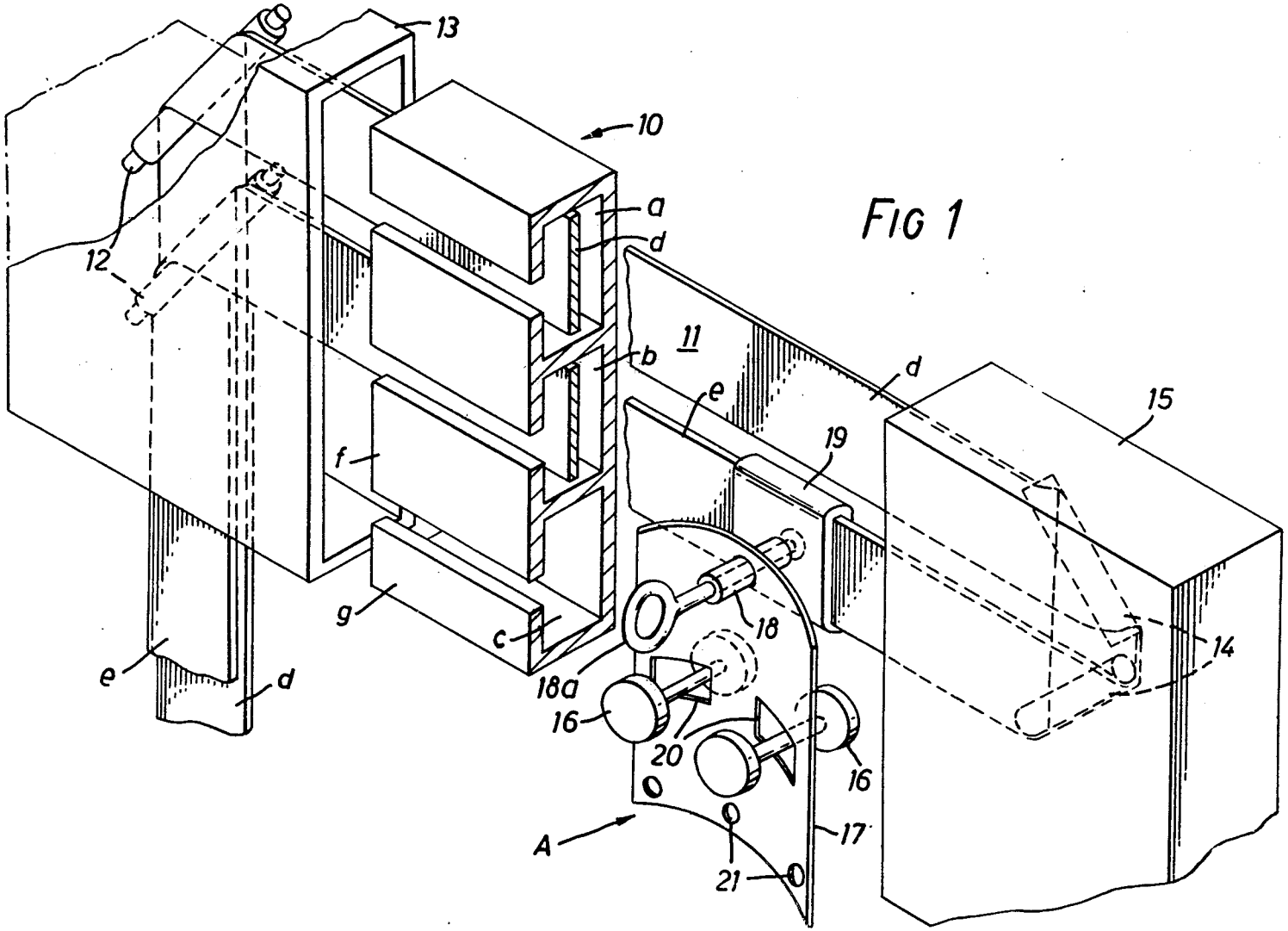
FIG. 1 is a perspective view of a first example having a rail with three aligned slots.

Referring to FIG. 1 the rail 10 of multiple channel section is shown in the position in which the long dimension of its cross section is vertical. The rail has a pair of equal slots *a b* for the upper and lower laps *d e* of a non-extensible flexible draw belt 11, which is guided over a pair of deflecting pulleys 12 carried in a pulley block 13 at one end of the rail and a pair of reversing or return pulleys 14 in a pulley block 15 at the other end. A master glider device indicated by the general reference "A" has a pair of dumbell shaped glider elements 16 supported to run in a third slot *c*. The master glider device includes a curved support plate 17 through which passes a socket 18, in which a threaded eye bolt 18*a* is rotatable to tighten a belt clamp 19 to exert a frictional grip on the lower span *e* of the belt in any suitable manner. The elements 16 pass through guide holes 20 in the plate 17 which has holes 21 for connection by hooks (not shown) in known manner to a curtain tape (not shown). In use the master glider device is pulled along the rail by the belt during which time the curved plate 17 slides along the rear flanges *f g* of the rail. The free gliders (not shown) also run in slot *c*.

A second master glider device, similar in all functional respects to "A", and therefore not shown here, is provided for the upper span *d* of the belt.

Figure 2:
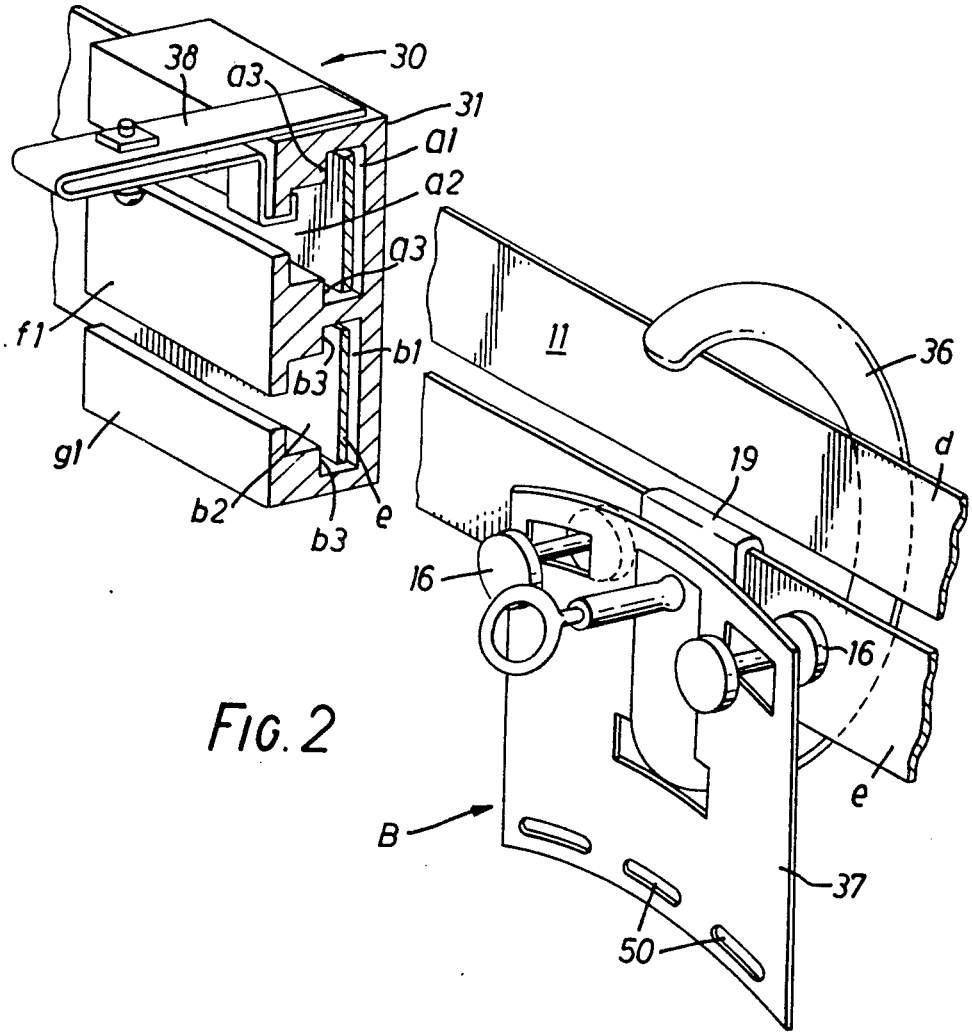
FIG. 2 is a second example having a rail with two belt slots, each of which is contiguous with a further slot for a master glider device.
Figure 4:
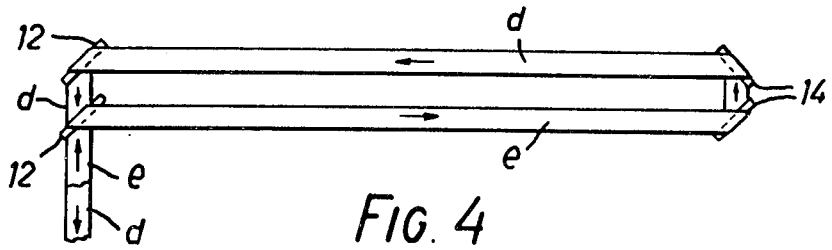
FIG. 4 is a schematic diagram of a belt and pulleys.

In FIG. 2 a double slotted rail 30 is shown of more compact cross-section in which the glider tracks are parallel to and laterally adjacent the belt slots. For example, here the gliders 16 of the lower master glider device "B" run at substantially the same level as the lower span *e* of the belt 11. This is achieved by forming the rail slots of substantially mushroom or hammer head cross section so that the belt slots *a*1 and *b*1 are each contiguous with a glider slot *a*2 and *b*2 respectively. The glider slot is of smaller vertical dimension than the belt slot so that the top and bottom flanks *a*3 and *b*3 of the belt slots prevent any tendency of the belts to deflect into the glider slots and foul the gliders 16.

The master glider device "B" is generally similar in construction and function to that shown at "A" in FIG. 1, except that a "G" shaped yoke 36 is affixed to the plate 37 and encircles with clearance the front flange 31 of the rail. This yoke can also be used in combination with the free gliders (not shown) for attachment in known manner to the curtain tape, so that when viewed from the front the system simulates the appearance of a conventional curtain support rail with rings. The aspect is enhanced if a decorative facing of semicircular or other curved cross section, corresponding to that of the yoke 36, is applied to, or moulded with, the front flange 31 of the rail. In use the draw belt moves clamp 19 of the master glider device "B" through the slot *b*1 whilst the glider elements 16, as well as the free glider elements (not shown) move in the slot *b*2. At the same time the plate bears against the rear flanges *f*1 *g*1 of the rail.

Again, the master glider device and clamp for the top span *d* of the belt are generally similar to "B" and are therefore not shown here. It follows that the master glider for the top span of the belt performs in a manner analogous to that described above. It is not essential for the master gliders of the top belt span *d* to run in slot *a*2. It is equally possible for these gliders to run also in slot *b*2 instead of slot *a*2, and it is only necessary to effect a simple modification of the master glider device for that purpose.

FIG. 2 also shows an example of a bracket 38 for ceiling or wall fixing of the rail 30. In the case of wall fixing a wall fitting (not shown) is used in combination with the bracket.

Figure 3:
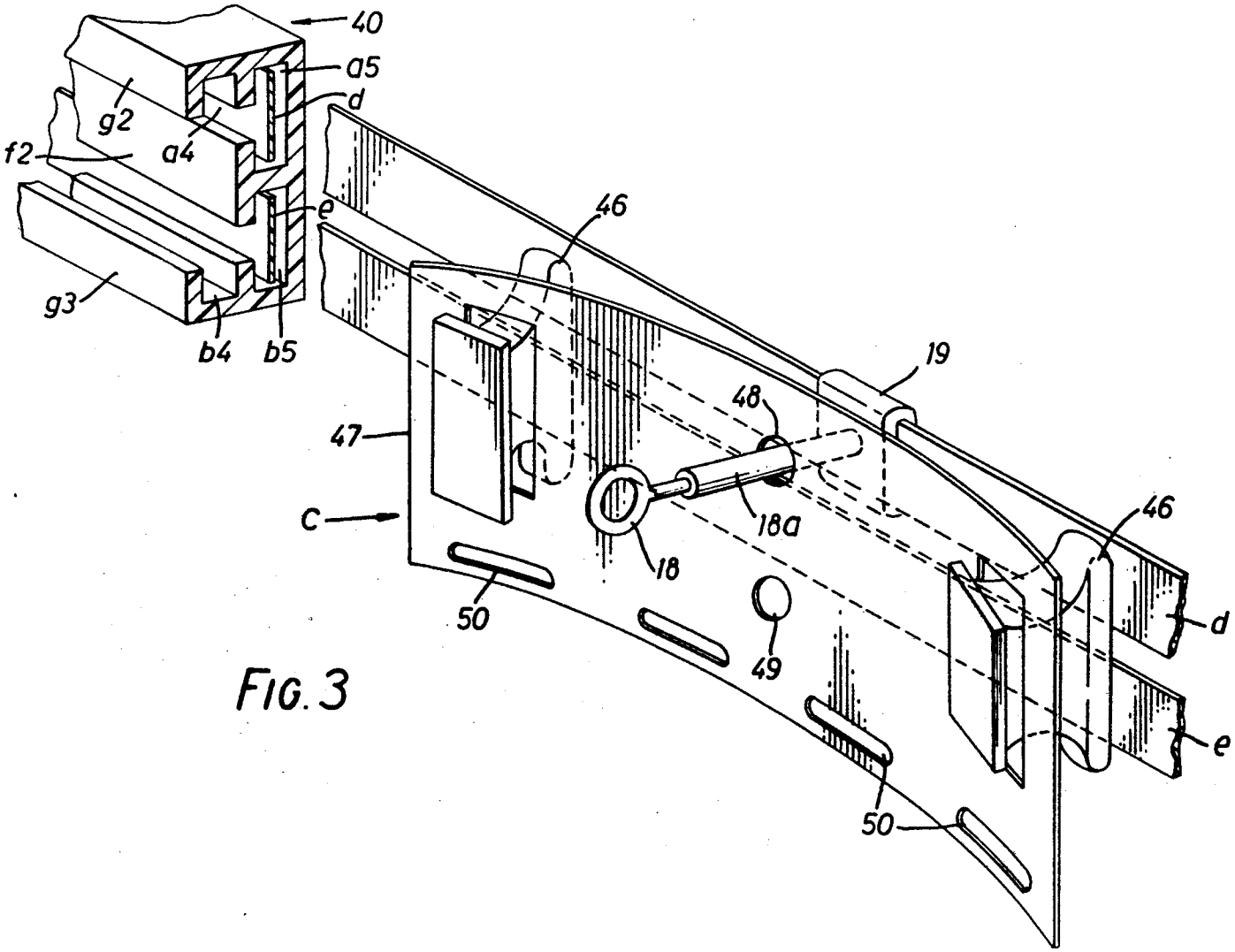
FIG. 3 is a third example, similar to the second, except that a common master glider slot is provided.

FIG. 3 shows a further example in which a single master glider track is common to the pair of belt slots *a*5 and *b*5 of the rail 40. The glider track comprises the upper and lower grooves *a*4 and *b*4, the vertical inner walls of which are aligned with the central web flange *f*2 of the rail.

The master glider device "C" for both belt spans is of similar construction. Here is shown the device for the top span *d*. The curved plate 47 is fitted with a pair of glider elements 46 shaped to slide in the grooves *a*4 and *b*4 whilst the back of the plate slides along the rear flanges *g*2 and *g*3 of the rail. The clamp 19 is tightened by the bolt 18 in socket 18*a* passing freely through a hole 48 in the plate 47 and connected to the clamp 19. A similar hole 49 is provided for the socket of the lower bolt (not shown). Elongated holes 50 are provided for the curtain hooks (not shown).

The rail could be used with other configurations of belt. For example the rail in FIG. 1 could be adapted to have an individual belt allotted to each of the two upper slots, that is to say each of these slots would have both the back and front spans of the same belt running parallel in the same slot, each of which belts would have its individual deflecting and return pulleys. This arrangement could support separate curtains for a number of different window openings equal to the number of belt slots in the rail.

All of the rails may be adapted for ceiling fixing by the use of obviously modified fixing brackets for screwing to the ceiling.

Figure 5:
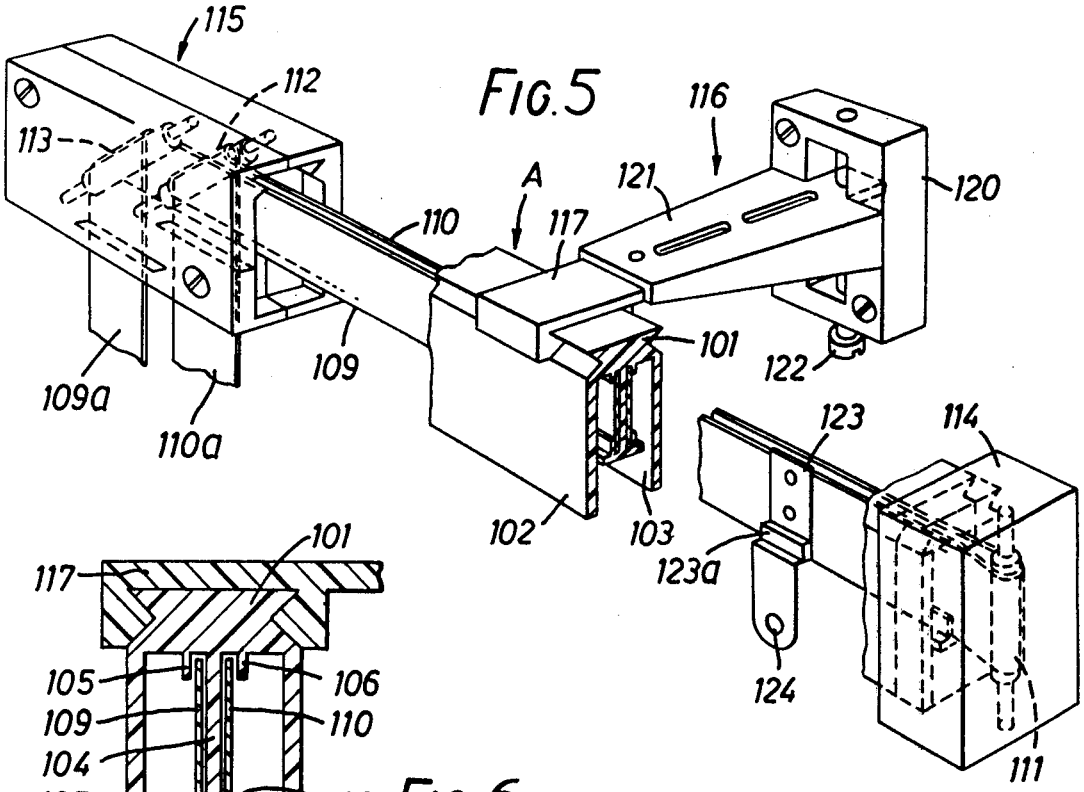
FIG. 5 is a perspective view showing the main parts of another example using a cross-section hollow box curtain rail system.
Figure 6:
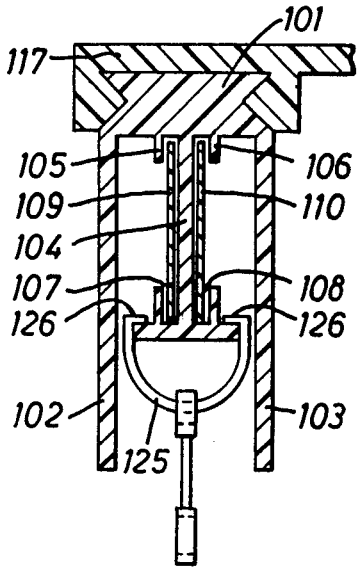
FIG. 6 is an enlarged cross-section of the rail shown of FIG. 5 showing curtain runners in position.

The curtain rail of FIGS. 5 and 6 consists of an extruded plastics bar A of downwardly open box section. The solid cross-head 101 of dovetail cross-section is integral with parallel side walls 102, 103, a central web 104 and pairs of guide flanges 105, 106, forming vertical slots 107, 108 for the front and back spans 109, 110 of a single piece flexible draw belt, which extends the length of the curtain rail between a reversing guide roller 111 at one end and a pair of deflecting guide rollers 112, 113 for turning the belt through 90° at the other end to allow the respective belt ends 109*a*, 110*a* to be pulled vertically for drawing the curtain.

The system is supported at its ends by the moulded end sockets 114, 115, and intermediately by a number of wall brackets 116 spaced at suitable intervals. End socket 114 is shaped to slide over or enclose the rail A and carries bearings for the shafts of the deflecting rollers 112, 113. The wall brackets 116 each comprise a dovetail socket 117, a wall plate 120, a cantilever bar 121 and an adjusting screw 122. The end sockets 114, 115 and the plates 120 are formed with suitable fixing screw holes (not indexed).

Two draw clips, one of which is shown at 123 are provided for fixing to the inner end of each of a pair of curtains (not shown). The draw clip is clamped, eyeletted or rivetted to the draw belt in a suitable position and has an eye 124 for attachment to the curtain tape hook (not shown). The dimensions of the rail cross-section (FIG. 6) are such as to allow the draw clips to be supported on the rail and run freely without jamming. In the present case the draw clip 123 is formed with a step 123*a* for slidably supporting the clip on the flange 105 of the rail so that at no time is any part of the weight of the curtain taken by the draw belt. It is possible, however, as will be described later, to use the same basic type of runner for the curtain hooks and for the clip. The curtain runners one of which is shown at 125 have lugs 126 running on the bottom flanges of the rail.

Figure 7:
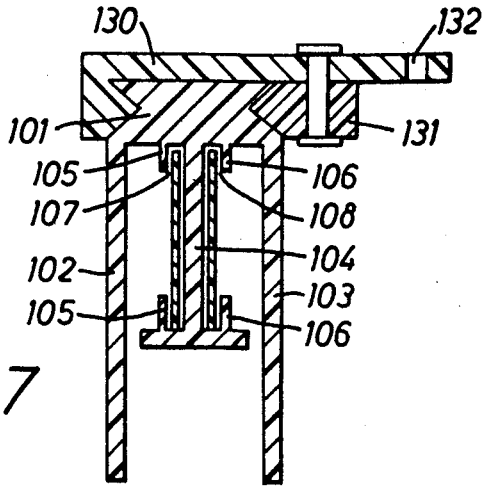
FIG. 7 is a cross-section showing a bracket for ceiling fixing.

In FIG. 7 the fixing bracket is modified for direct fitting to a ceiling. The bracket comprises a plate 130 with a mitre to fix at one side of the head 101, whilst at the other side a separate wedge member 131 is rivetted to the plate 130. If the wedge 131 is not rigidly fixed but is an arcuate sector pivoted to the plate 130 on a vertical axis the brackets may be directly fitted at any desired positions by using the ceiling fixing screw holes 132 prior to introducing the rail into the brackets, whereafter the sector wedges 131 are pivoted into a locking position.

Figure 8:
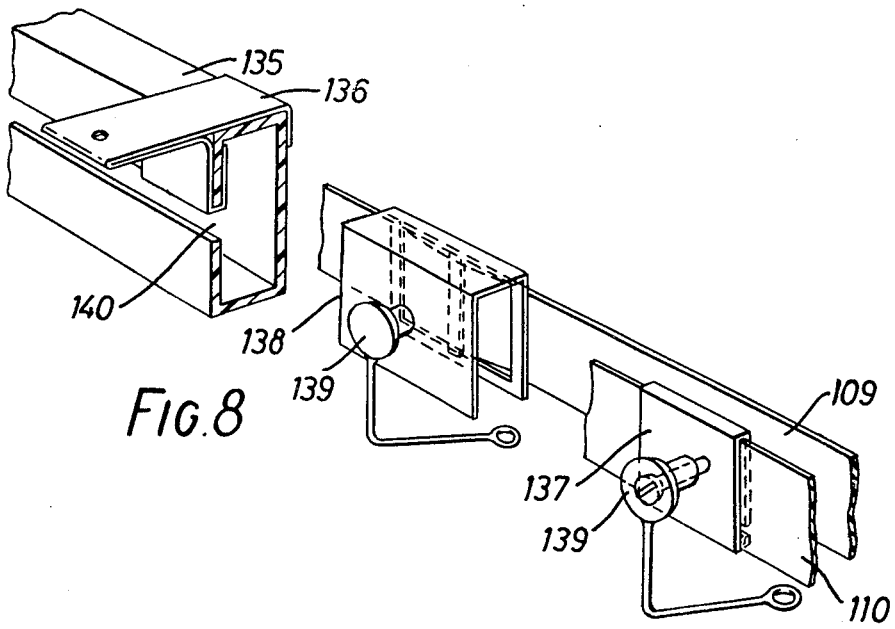
FIG. 8 is a perspective view of a still further curtain rail system having a hollow box section rail open at the rear side.
Figure 9:
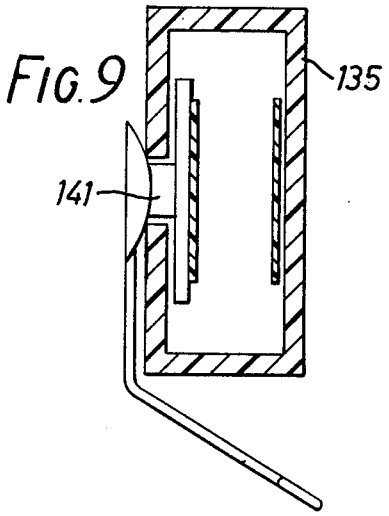
FIG. 9 is an enlarged cross-section of the rail shown in FIG. 8 showing a curtain runner in position.
Figure 10:
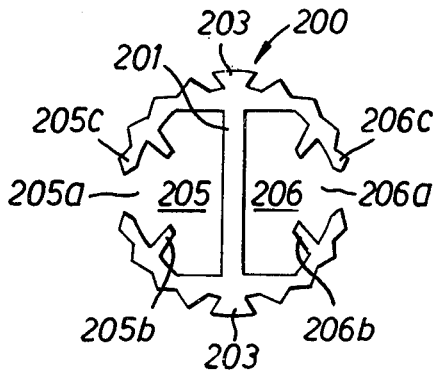
FIGS. 10–16 show a further example using a hollow rail symmetrical about a central vertical web.
Figure 11:
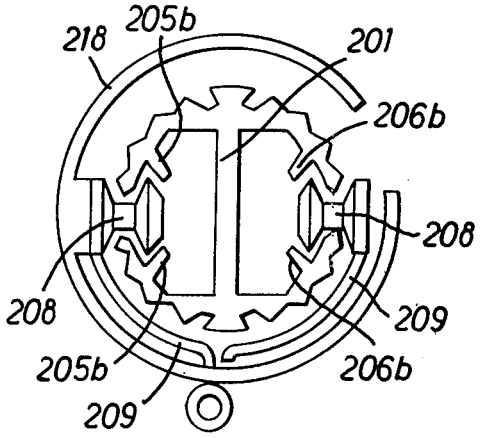

In the example of FIGS. 8 and 9, the pulleys and rollers may be similar in principle to those in FIG. 5 and are therefore not shown. The laps 109 and 110 of the belt run freely in the box section 135. Support brackets such as the one shown at 136 are adaptable either for ceiling or wall fixing. The rear lap of the belt carries a clip 137 and the front lap carries a "U" section clip 138 allowing the rear belt lap to pass inside until the two clips meet at the centre of the rail, whilst both clips can run through the box cross-section rail. Each clip is supported by a master glider or runner 139, itself supported in a back slot 140 in the rail. A curtain runner is shown at 141 in FIG. 9.

The main parts of the rail system may be made of plastics, the rail itself by extrusion, and the components 114, 115, 116 by injection moulding. The parts may, however, be made of extrusions and die castings of ductile metal such as aluminium, or mild steel pressings may be used for at least some of the components.

According to a further example of the invention a rail for a drawable curtain or the like suspension system comprises a continuous, preferably extruded or drawn, rail having a vertical web separating the cross section into two substantially equal compartments, which are so shaped that they form slots within which the oppositely running laps of a draw belt may be respectively guided parallel to, but separated from, each other. The web is preferably an integral part of the rail.

The cross-section is also shaped to receive within each slot a master glider with a fastening device securable to the belt, and carrying a device, such as a suspender, securable to the respective curtain for drawing the same. The fastening device may be, for example, a clip permanently fixed by screws, rivets, or eyelets to the belt. Preferably, it may be a screw clamp adjustable to grip the belt without permanently damaging or distorting the material.

Preferably the rail cross section is symmetrical about the vertical plane containing the web and so that similar front and rear hollow compartments are shaped each to contain a belt lap, the fastening device and the associated master glider, as well as the free running curtain gliders. Such an arrangement is most conveniently achieved by a rail of hollow tubular or box shape cross-section centrally split at each side along a horizontal plane, i.e. normal to the plane of the vertical web, to provide a pair of longitudinally continuous slots, laterally open respectively at the back and front of the rail for guiding and supporting the master gliders, and the parts thereof extending laterally from said slots for making attachment to the curtains, as well as a number of free running gliders for attaching to the curtain heading tape.

In a particular preferred construction the rail is of substantially hollow round or oval cross-section, and is provided in each symmetrical half, at each side of the central web, with a pair of longitudinal ribs, projecting radially inwards. The inner ends of the ribs serve to locate a master glider belt clamp and to prevent the belt slipping out when the belt runs in a curve, whilst the flange surface of said ribs form, together with a part of the rail adjacent the lateral opening of the slot, a continuous track for the free running curtain gliders. Such gliders may be of dumbell shape with an inner head thereof in the track, the neck passing horizontally through the slot opening, and connected to the outer head running outside the rail and carrying a curtain suspender.

The rail may have an integrally formed tongue, for example, a dovetail, for sliding engagement with a fixing bracket of complementary shape, which can be shaped either for wall or ceiling fixing.

Both the master gliders and the free running gliders may have "C" shaped rings embracing the curtain rail and serving to enhance the external appearance.

Referring now to FIGS. 10 through 16 of the drawings the rail 200 is integrally formed, for example, by extrusion if made of plastics material. The cross-section is symmetrical and therefore capable of equal flexing or bending in either direction about the vertical web 201 and is of substantially hollow circular shape. The outer surface is fluted for decorative effect, as at 202, and dovetail ribs 203 are formed at the ends of the web to make sliding engagement with fixing brackets 204.

Figure 12:
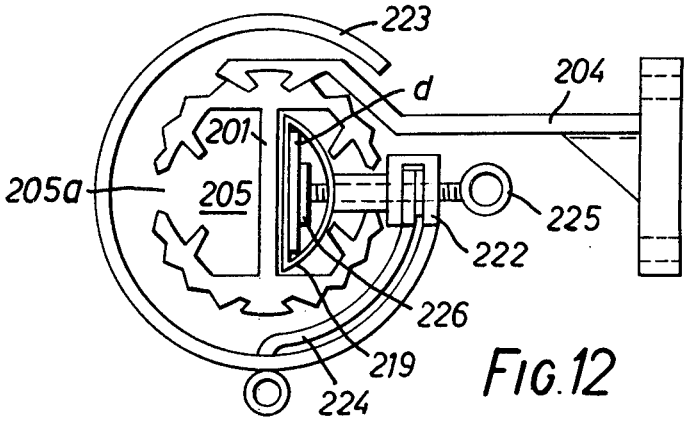

The rail is longitudinally split at each side to form equal compartments each consisting of a large inner slot 205, 206 at either side of the central web, these slots leading to laterally open smaller slots at 205*a*, 206*a*. These smaller slots are in part defined by pairs of internal ribs 205*b*, 206*b* projecting radially inwards. These serve the functions of preventing the belt from slipping outwardly, especially when rounding a curve, as well as for guiding and locating two master gliders with belt clamps of "D" section, of which the rear one 207 is shown in FIGS. 12 and 13, whilst the front belt clamp 217 is shown in FIG. 14. The outer slots 205*a*, 206*a* have their shape defined by the ribs 205*b*, 206*b* and the adjacent flanges 205*c*, 206*c* of the rail to form front and rear tracks for the substantially dumbbell shaped curtain gliders 208 which carry the curtain suspenders 209. A front glider is shown attached to a rearwardly open "C" ring 218 embracing the rail. Similar "C" rings, also rearwardly open, are provided for the rear gliders, but these rings are not shown to avoid complicating the drawing.

Referring particularly to FIGS. 12 to 16 the parallel laps *d*, *e* of a flexible draw belt are guided at one end of the rail over a reversing pulley 210 in a block 211 and at the other end over two deflecting pulleys 212, 213 in a block 214. The pulley blocks 211, 214 may be moulded in the same or a similar material to the rail 200 and have, to a convenient depth, internal sockets 215, 216 of the same cross section as the exterior of the rail so that the blocks may be pushed on and clamped, for example by a grub screw (not shown).

The rear master glider and belt clamp 207 comprise a "D" shaped yoke 219 carried on a sleeve 221, which supports a boss 222 having a rearwardly open "C" ring 223 embracing the rail and a suspender 224 for attachment to a curtain hook. The eye of the suspender may, as shown, pass through the "C" ring at the bottom. The sleeve 221 is internally threaded to receive a bolt 225 carrying a captive buffer plate 226 coaxial with a hole 219*a* for clamping the belt *d*. A functionally similar arrangement is shown at 217 in FIG. 14 for the second, in this case the front, belt lap *e*. A ring 220, similar to 223, is removably secured to a suspender 230 carried on the sleeve 221. In this case however, for enhanced decorative appearance of the assembly, the clamping screw head 231 is concealed from view between the ring and the suspender 230.

Although the rail has been described as a plastics extrusion, the alternative of a drawn metal rail is possible, a desirable quality being that the rail can be bent to conform to smooth curves of a bay without substantially distorting the cross-section and causing jamming of the master gliders 207, 217 in the compartments 205, 206. Moreover, although an integral rail is preferable, a composite rail may be employed in which the centre web 201 is a separate strip which can be slid into dovetail or similar sockets in two substantially semi-circular top and bottom rail parts to complete a rail of a shape analogous to that shown in FIG. 10. The "C" rings and other components may also be of plastics or of metal.

The general cross-section of the rail may be varied in shape for example an elliptical or rounded rectangular shape with a central web is possible giving equivalent advantages. Again the internal configuration must be such as to avoid jamming of the master gliders and the slipping out of the belt on a curved track. Also the clamp may be of box section instead of "D" shape.

Figure 13A:
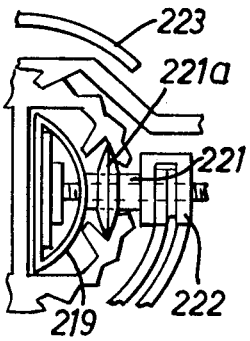
FIG. 13A shows a partial end view of FIG. 13.
Figure 13:
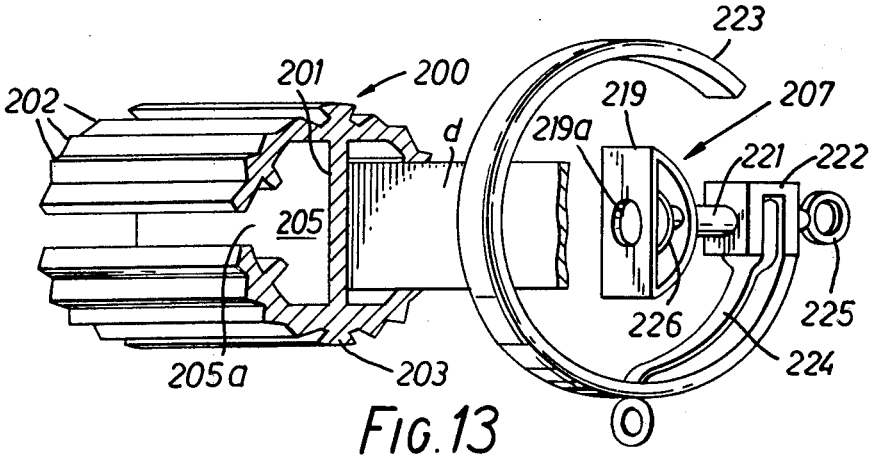
Figure 14:
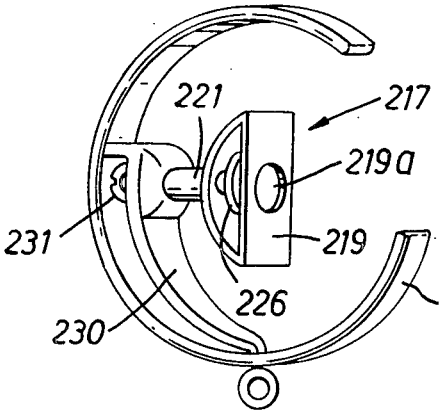

Additional support for the master glider and belt clamp of the kind shown in FIGS. 12, 13 and 14, may, if desired, be provided, as shown in FIG. 13*a*, by a free runing roller 221*a* rotatable about the sleeve 221 of the clamp and having a tapered cross-section similar in part to that of the gliders 208 for engagement with the tracks provided by the ribs 205*b*, 206*b* of the rail.

Figure 15:
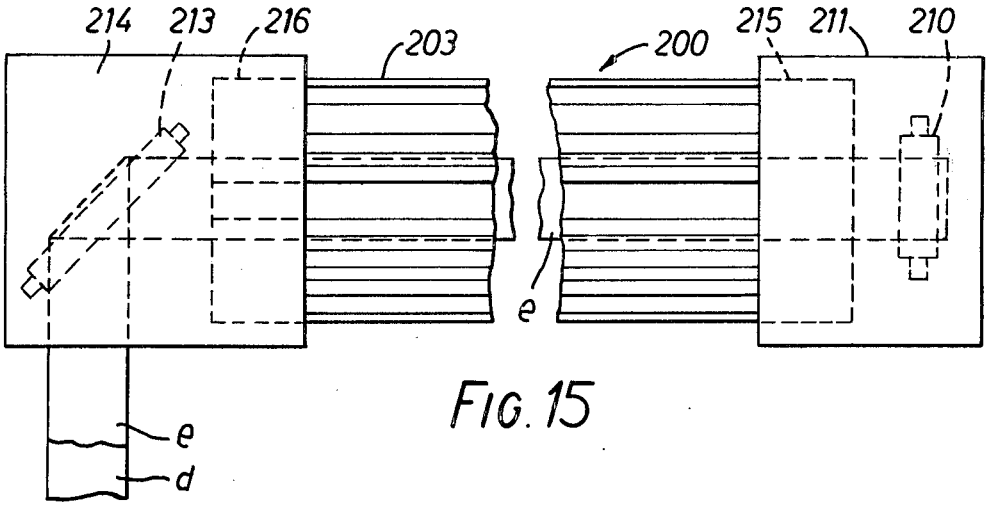
Figure 16:
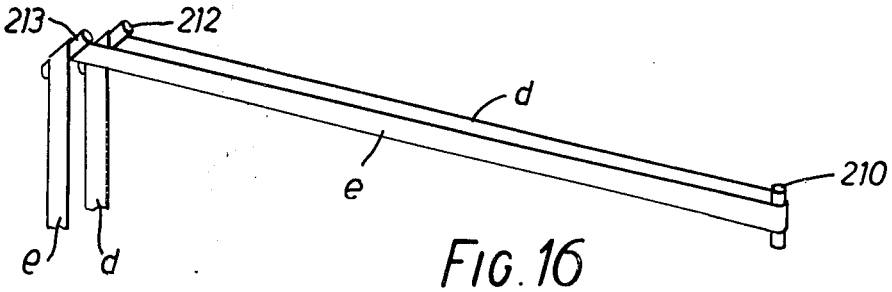
Figure 17:
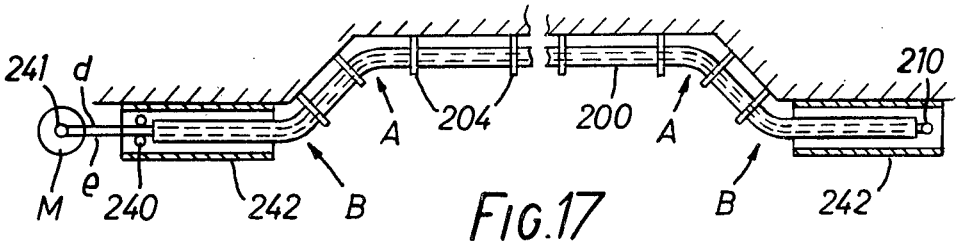
FIG. 17 shows a schematic plan of a rail curved to fit a bay.

Although a two-ended belt has been described it is possible to use instead an endless belt in some situations. FIG. 17 shows diagrammatically a rail 200 supported by wall or ceiling brackets 204 at suitable intervals, and bent in opposite directions at the points A and B to conform to the shape of a bay. The belt passes at one end over a reversing roller 210 and at the other end passes between a pair of guide rollers 240 and over the driving pulley 241 of a motor M. The pulley blocks, which may be similar to 211 and 214 of FIG. 15, are not shown here, and may be housed underneath side wings 242, into which the drapes are drawn to expose the full area of the bay window when required.

The systems above described using a draw belt instead of the conventional cords offer valuable advantages. For example the belt systems are easier and quicker to assemble than corded systems, the belts cannot twist individually nor can they entangle with each other, which are common drawbacks of corded systems. The belts may have holes punched therein at convenient intervals. Such holes may facilitate the securement of master glider clamps. Additionally the holes may assist in the securement of louvres at determined intervals in louvre drape systems, or may serve to facilitate connection to individual cogs to rotate such louvres.

The rails described herein are not restricted in their use to curtains or the like but can equally well be used for any belt drawn system of gliders supported by the rail.

It will be understood that the facility for fitting to a curved bay without distorting the cross-section sufficiently to jam the gliders or cause the belts to run out of the slots is attributable to the design of the cross-section of the rail, and the use of a material which can be drawn or extruded, but which will impart to the rail the necessary flexibility or yieldability. Aluminium alloys are suitable as are certain plastics materials. It matters not whether the rail has elastic bendability with the resilience to return to the truly rectilinear shape, or whether, as in the case of some metal alloys, the material assumes the desired curvature of the bay under a slight amount of cold flow and therefore without the tendency to return to the original shape.

The use of a generally rounded, e.g. circular or elliptical, metal cross-section, which is symmetrical about two mutually normal axes and having a central vertical web separating the slots has been found to be efficient in respect of conformability to a smoothly curved bay.

What I claim is:

1. A draw rod system for curtain and like suspension systems comprising a rail of continuous extruded material of generally hollow cross-section and having a thin central integral web to provide two continuous parallel slots back to back on opposite sides of said web for guiding with vertical and horizontal clearance within the rail oppositely moving spans of a flexible drawing means of flat cross-section having a height substantially greater than its thickness, each slot and its contained flexible drawing means being situated in the same vertical plane, said thin web together with the slots affording preferential horizontal flexibility of the rail transverse to the plane of the web, the outer vertical boundary surfaces of the web each forming the vertical inner wall of a respective slot, and the respective outer wall of each slot, which lies opposite to the vertical inner wall, being interrupted by an outwardly open channel extending continuously along the length thereof and of a height less than the height of said flexible drawing means, a master glider secured by a clamping and connecting means to the respective span of the flexible drawing means, said master glider clamping and connecting means cooperating slidably with the slot walls and with said outwardly open channel during the longitudinal movement of the flexible drawing means.

2. A rail for curtain and the like suspension systems as claimed in claim 1, said master glider clamping means having a manually operable member extending through said outwardly open channel and accessible externally thereof, said member having a rigid connection to a supporting ring slidably along and externally embracing the rail.

3. A rail for curtains and the like suspension systems as claimed in claim 2, wherein the rail is of rounded "I" cross-section, and the two slots for the flexible drawing means are substantially of "D" cross-section, said slots surrounding with sliding clearance the part of the clamping means secured to the flexible drawing means, and said outwardly open channels of the slots forming tracks to support curtain suspension runners.

4. A curtain system according to claim 1 further comprising roller means for changing the direction of the spans of the flat drawing means by 90° to provide vertical runs for operating the drawing system, said roller means comprising a thin roller for each span of the belt and having its axis at a 45° angle and in a plane between the respective spans and runs of the drawing means.

5. A suspension and drawing system for curtains and the like comprising a curvable rail of continuous extruded material of generally hollow box shape closed at one vertical face and having longitudinal channels extending along its other face, said rail having a cross-sectional height greater than its cross-sectional width and providing at least two parallel superimposed longitudinal vertically coplanar slots with their major dimensions vertical when in use, a flat draw belt having oppositely movable spans thereof located in a vertical on-edge attitude in two of said vertically aligned slots adjacent to each other, the vertical dimension of said belt being greater than the height of a channel, and a master glider attached to each span of the draw belt by attachment means externally accessible through one of said longitudinal channels at the open side of the rail.

6. A system according to claim 5 wherein roller means reverse said draw belt at one end of said rail, said roller means comprising, a first thin roller having its axis at a 45° angle, and a second thin roller having its axis at a 90° angle to said first roller, said axes of the rollers being in a common vertical plane parallel to the belt at said one end.

7. A suspension and drawing system for curtains and the like comprising a rail of continuous extruded material of generally hollow box shape closed at one vertical face and longitudinally channelled at the other end having a cross-sectional height greater than its cross-sectional width and providing at least two parallel superimposed longitudinal vertically coplanar slots with their major dimensions vertical when in use, a flat draw belt having oppositely movable spans thereof located in a vertical on-edge attitude in two of said vertically aligned slots adjacent to each other, wherein each belt slot has a continuous longitudinal channel facing laterally outward from a side of the slot which is vertical when in use, the vertical dimension of said channel being les than the internal height of the slot and the height of the draw belt, and including means for attaching a master glider to the belt comprising a member projecting through each channel opening and having at the inner end a clamp attached to the belt and at the outer end a master glider having a part thereof supported for slidable movement along the outside of the rail in a direction parallel to said slots.

8. A system as claimed in claim 7, including two belt slots which are positioned vertically above each other in the same plane, and a master glider clamping means for each belt span in each slot, wherein each master glider includes a smoothly curved plate slidable along and resiliently in contact with a surface of the rail outside each belt slot and carrying at least one curtain runner in contact with a substantially horizontal support track integral with the rail.

9. A system as claimed in claim 8, wherein the rail has first and second vertically superimposed belt slots and a third parallel slot vertically below said belt slots, a first master glider clamped to a belt span in the top slot and a second master glider clamped to a belt span in the middle slot, and separate support means attached to said first and second master gliders and arranged to run in a track constituted by said third slot.

10. A system as claimed in claim 8, wherein the rail has first and second vertically superimposed belt slots each having a longitudinal channel opening facing outwardly from the belt slot, said channel openings each leading into a further parallel slot, one of said further slots providing a support track for a first master glider support means associated with a first belt clamp, and a second one of said further slots providing a support track for a second master glider support means associated with a second belt clamp.

* * * * *